United States Patent [19]

Moretti et al.

[11] 4,339,926

[45] Jul. 20, 1982

[54] VORTEX TUBE

[75] Inventors: Anthony L. Moretti, San Rafael; Lester W. Ferris, Tiburon, both of Calif.

[73] Assignee: E. D. Bullard Company, Sausalito, Calif.

[21] Appl. No.: 289,534

[22] Filed: Aug. 3, 1981

[51] Int. Cl.[3] ..... F25B 9/02

[52] U.S. Cl. ..... 62/5; 138/44

[58] Field of Search ..... 62/5; 138/44

[56] References Cited

U.S. PATENT DOCUMENTS

| | | | |
|---|---|---|---|
| 3,129,075 | 4/1964 | Anliot | 62/5 |
| 3,192,728 | 7/1965 | Timm | 62/5 |
| 3,208,229 | 9/1965 | Fulton | 62/5 |
| 3,214,923 | 11/1965 | Palmisano et al. | 62/5 |
| 3,287,924 | 11/1966 | Bright | 62/5 |
| 3,291,126 | 12/1966 | Messick | 62/5 |
| 3,296,807 | 1/1967 | Fekete | 62/5 |
| 3,461,676 | 8/1969 | Toelke et al. | 62/5 |
| 3,630,039 | 12/1971 | Hayashi | 62/5 |
| 4,240,261 | 12/1980 | Inglis | 62/5 |

*Primary Examiner*—Ronald C. Capossela
*Attorney, Agent, or Firm*—Phillips, Moore, Lempio & Majestic

[57] ABSTRACT

A vortex tube has a vortex generator portion in the form of a right circular cylindrical re-entrant cavity having end walls defining a right circular cylindrical volume therewithin with a nozzle means separating such volume from the remainder of the cavity. Pressurized air or other gas is introduced into the cavity through an appropriate coupling and is caused to swirl by the nozzle means to produce a vortex within such volume. A stream of higher temperature gas is coupled from one side of the vortex generator by a tube of given length and diameter smaller than the diameter of the vortex volume and a stream of lower temperature gas is coupled from the other side of the vortex generator through an opening of smaller diameter than the tube. Longitudinally extending grooves in the inner surface of the distal end portion of the tube enable a given temperature differential between the high and low temperature streams to be obtained with a tube of reduced length. A valved passageway between the portion of the cavity outside the vortex volume and the tube enables the temperature differential between the high and low temperature streams to be adjusted without substantial change in the amount of flow in either of such streams.

10 Claims, 7 Drawing Figures

VORTEX TUBE

DESCRIPTION

1. Field of the Invention

This invention relates to vortex tubes and more particularly to an improved vortex tube structure of reduced size and complexity providing both efficiency and temperature control.

2. Background of the Invention

A vortex tube is a device capable of separating a stream of pressurized air or other gas into two streams of different temperature. The basic concept and design principles known in the prior art are disclosed in U.S. Pat. Nos. 1,952,281 and 3,208,229.

It is noted that although the vortex tube is based on a surprising and perplexing phenomena, many years elapsed before practical applications for the device emerged. Perhaps the most practical application for the vortex tube has been found in recent years in connection with the supply of air to persons wearing protective clothing and headgear as disclosed in U.S. Pat. Nos. 3,291,126 and 3,630,039.

One major problem encountered in the use of vortex tubes to supply air to persons wearing protective clothing and headgear is the control of the temperature of the air supplied to the person. Basically, a vortex tube resembles a "T" fitting with its stem connected to a source of pressurized air or other gas. If properly designed, a cold stream will be discharged from one branch of the "T" and a hot stream will be discharged from the other branch of the "T". As a general rule, the greatest temperature difference between the hot and cold discharge streams will occur when the volume of the hot discharge stream exceeds the volume of the cold discharge stream by a given amount depending on the design of the particular device.

Thus, as disclosed in U.S. Pat. No. 3,192,728, it is conventional in the prior art to control the temperature of the discharge stream by valving the hot discharge stream. This method of temperature control has the disadvantage of increasing the volume of the cold discharge stream in order to increase its temperature. Thus, the cooling effect of the cold discharge stream will tend to remain constant since any increase in temperature of the stream will be counteracted by the increased cooling effect of the increased flow. A similar, but less pronounced, counteraction occurs with respect to the hot discharge stream where the decrease in volume of stream tend to counteract the effect of the decrease in temperature of the stream.

Thus, it is desirable to be able to control the temperature of the hot and cold discharge streams without changing the volume of flow in such streams. U.S. Pat. No. 4,240,261 discloses a complicated mechanism for mixing the hot and cold discharge streams with each other in varying amounts in an attempt to obtain the desired temperature while maintaining the flow volume of the mixture constant. Not only is the mechanism disclosed in U.S. Pat. No. 4,240,261 expensive to fabricate, but it tends to reduce the efficiency of the device, since the hot and cold discharge streams must flow in parallel to a common end of the device for mixing and discharge with consequent temperature interchange between the streams along the length of such parallel flow.

Efficiency of the device is important in order to provide the desired temperature differential between the hot and cold discharge streams in a compact structure that may be conveniently carried on the person of the user. According to the prior art, the length of the cold discharge branch of the "T" was found to be unimportant but the length of the hot discharge branch of the "T" was found to be quite important. Basically, it was found that the length of the hot discharge branch must be equal to about fifty times its diameter in order to approach maximum efficiency but that such length could be reduced to about twenty times its diameter by placing a transverse blade in the distal end thereof without loss of efficiency.

U.S. Pat. No. 3,208,229 discloses further attempts to make the vortex tube more compact. Specifically, this patent points out that roughening the inner surface of the tube was found to produce turbulance and mixing that reduced efficiency of the tube and proposed the use of a control ring in conjunction with the blades at the distal end of the "hot" tube to enable the tube to be further shortened to about ten times its diameter without loss of efficiency.

It is an object of this invention to provide a simple, inexpensive vortex tube having a length less than about five times the diameter thereof with sufficient efficiency to provide a temperature differential of about 80° F. between the hot and cold streams without the use of blades or control rings.

It is a further object of this invention to provide a simple, inexpensive temperature control for both the hot and cold streams of a vortex tube capable of functioning without substantially changing the volume of the flow in either stream and without mixing of the streams or reducing the maximum efficiency of the device.

SUMMARY OF THE INVENTION

A vortex tube has a generator portion defining a right circular cylindrical re-entrant cavity with planar end walls. The re-entrant portion of the cavity defines a right circular cylindrical volume within the cavity and a nozzle means is interposed between the volume and the cavity with the nozzle means extending tangentially to the volume. An inlet tube communicates with the portion of the cavity outside the volume. A first outlet tube of given length and having a diameter smaller than the diameter of the volume communicates with the volume concentrically therewith through one end wall of the cavity. A second outlet tube communicated with the volume concentrically therewith through an opening in the other end wall of the cavity having a diameter smaller than the diameter of the first outlet tube. According to this invention, a longitudinally extending groove is provided in the inner surface of the outlet tube. Also according to this invention, a passageway communicates between the portion of the cavity outside the right circular volume therewithin and either the first outlet tube or the second outlet tube at a point adjacent the volume and a valve means is provided for selectively closing such passageway.

BRIEF DESCRIPTION OF THE DRAWING

This invention will be more fully understood from a reading of the following specification in conjunction with the appended drawing wherein.

DETAILED DESCRIPTION OF THE INVENTION

Figure 1:
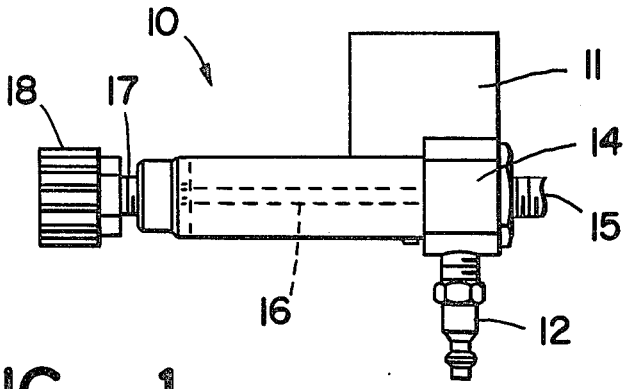
FIG 1 (PRIOR ART)
FIG. 1 is a side view in elevation showing a vortex tube constructed in accordance with the teaching of the prior art.
Figure 2:
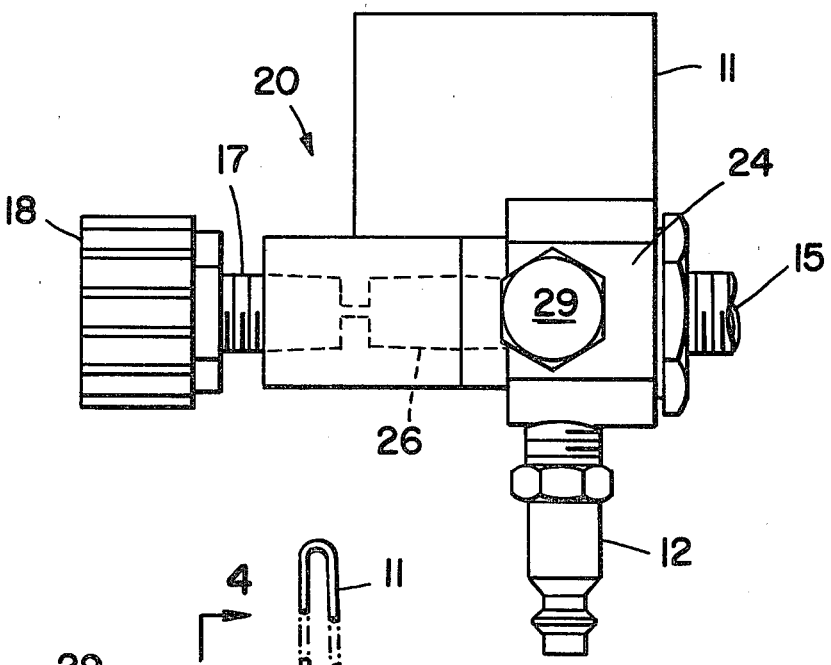
FIG. 2 is an enlarged side view in elevation of a vortex tube comparable to the vortex tube of FIG. 1, but constructed in accordance with the teaching of this invention.

Referring to FIG. 1, a vortex tube 10 constructed according to the teaching of the prior art for use in supplying air to a person wearing protective clothing and headgear is shown for comparison with the vortex tube 20 of FIG. 2, constructed for the same purpose in accordance with the teaching of this invention. Thus, a loop or bracket of metal or other suitable material may be provided to enable a vortex tube of either construction to be carried on the belt of the user.

Similarly, regardless of the construction of the vortex tube, it may be provided with a quick disconnect type hose coupling 12 for connection to a source of pressurized air or other suitable gas.

As is conventional in the prior art, the coupling 12 communicates with the vortex generator portion 14 of the vortex tube 10. A low temperature or cold stream of the air or other suitable gas introduced through the coupling 12 may be coupled directly from the vortex generator 14 by a suitable coupling 15 at one side thereof and a high temperature or hot stream of such gas may be coupled from the vortex generator 14 through an elongated passageway 16 and an appropriate coupling 17 from the opposite side of the vortex generator 14.

It will be understood that the primary advantage of the vortex tube 10 in the usual situation is its ability to provide a cold stream of air or other suitable gas. There are many equally simple and inexpensive devices for providing a hot stream of air or other suitable gas but there is no other device as simple and inexpensive as a vortex tube for providing a cold stream of air or other suitable gas. Thus, in the usual situation, the hot stream is exhausted to the atmosphere through an appropriate muffler 18 and the cold stream coupling 15 communicates with the protective clothing, headgear, or other utilization device.

In the prior art, it was found to be desirable for a vortex tube constructed for use in supplying air to a person wearing protective clothing and headgear to be capable of providing a cold stream about 40° F. lower in temperature than the temperature of the pressurized air or other suitable gas provided at the coupling 12. According to the teaching of the prior art, it was necessary for the passageway 16 to have a length about equal to ten times its diameter in order to have an efficiency sufficient to provide the desired temperature differential. The diameter of the passageway 16, as well as of the inlet coupling 12, outlet coupling 15 and outlet coupling 17 are, of course, a function of the actual volume of air required for use as well as the pressure of the source. In any event, the requirement that the passageway 16 have a length at least about equal to ten times its diameter imposed a design limitation that prevented the vortex tube 10 from being made as small and compact as desired for use in supplying a cold stream of air or other suitable gas to a person wearing protective clothing. Furthermore, it was not possible according to the prior art to control the temperature of the cold air stream without adding to the size of the vortex tube 10.

As can be seen by comparing FIG. 1 with enlarged FIG. 2, a vortex tube 20, constructed in accordance with the teaching of this invention, is much more compact than the vortex tube 10, constructed in accordance with the teaching of the prior art. In FIG. 2, the belt loop or bracket 11, inlet coupling 12, cold stream coupling 15, hot stream coupling 17 and muffler 18, are identical to corresponding elements shown in FIG. 1. The vortex generator portion 24, according to this invention, is modified in order to enable the control of the temperature of the cold and hot streams, as will be discussed more fully hereinafter, but is otherwise substantially identical to the vortex generator portion 14 of the vortex tube 10 of FIG. 1. Similarly, the hot stream passageway 26 of the vortex tube 20, constructed according to the teaching of this invention, is modified as will be discussed more fully hereinafter, to provide an efficiency equivalent to the efficiency of the vortex tube 10 of FIG. 1 but with a length less than five times its diameter, resulting in a dramatic reduction in size.

Figure 3:
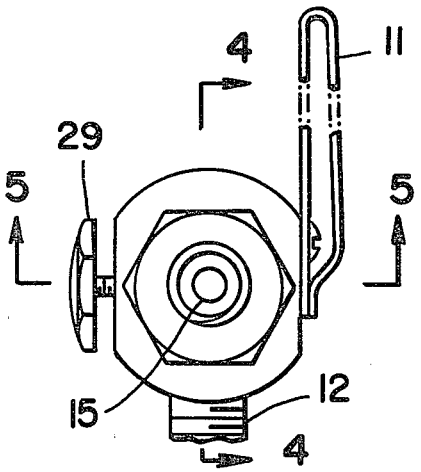
FIG. 3 is a fragmentary right end view in elevation of the vortex tube of FIG. 2.

As best shown in FIG. 3, the only enlargement in terms of external dimensions in a vortex tube 20, according to the teaching of this invention, over a vortex tube 10 according to the prior art, is contributed by the control knob 29 which projects slightly from the vortex generator portion of the vortex tube 20. As will be discussed more fully below, the knob 29 is provided in order to enable easy access for manual control of the temperature of the hot and cold streams in accordance with the teaching of this invention.

Figure 4:
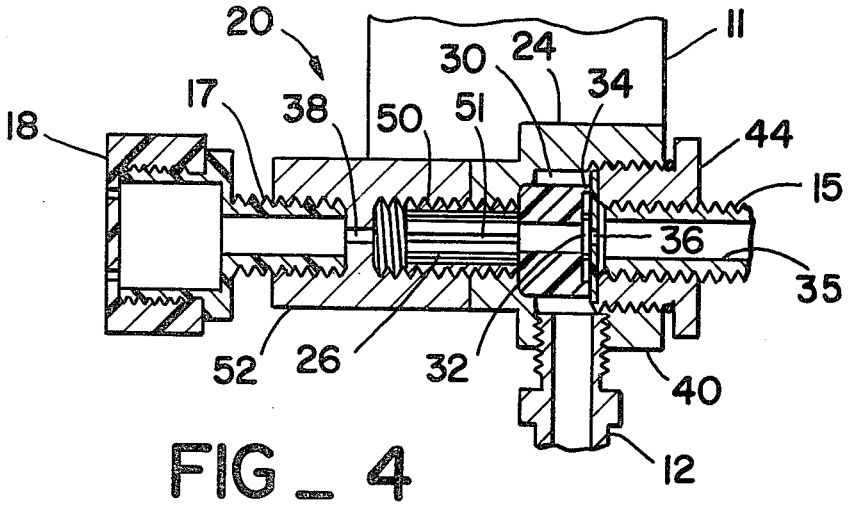
FIG. 4 is a cross-sectional view taken along lines 4—4 of FIG. 3.

Referring to FIG. 4, the vortex generator 24 comprises a re-entrant cavity 30 having right circular cylindrical sidewalls and planar end walls defining a right circular cylindrical volume 32 therewithin. A nozzle means 34 extending substantially tangential to the right circular cylindrical volume 34 is interposed between such volume 34 and the remainder of the re-entrant cavity 30. The inlet coupling 12 communicates with the portion of the re-entrant cavity 30 outside the right circular volume 32. Thus, pressurized air or other suitable gas from a source connected to the coupling 12 will be introduced into the cavity 30 and will pass through the nozzle means 34 into the circular volume 32. Due to the tangential orientation of the nozzle means 34 with respect to the volume 32, a vortex will be created within the volume 32 by the high velocity swirling action of the gases therewithin.

A first outlet passageway 26 of given length and having a diameter smaller than the diameter of the circular volume communicates concentrically with the circular volume through one end wall of the re-entrant cavity 30 for discharge of the hot stream therefrom. A second outlet passageway 35 communicates with the circular volume concentrically thereof through an opening 36 in the other end wall of the re-entrant cavity 30. The opening 36 has a diameter smaller than the diameter of the first outlet passageway 26 and provides for the discharge of the cold stream from the vortex tube.

The above structure as broadly described, is conventional and common to all vortex tubes. Thus, a suitable coupling 15 in the second outlet passageway will receive the cold air stream from the opening 36 and conduct it to the desired utilization device. Similarly, a conventional coupling 17 communicating with the first outlet passageway 26 through a suitable opening 38 may conduct the hot air stream to an appropriate muffler 18 for exhaust to the atmosphere.

Figure 5:
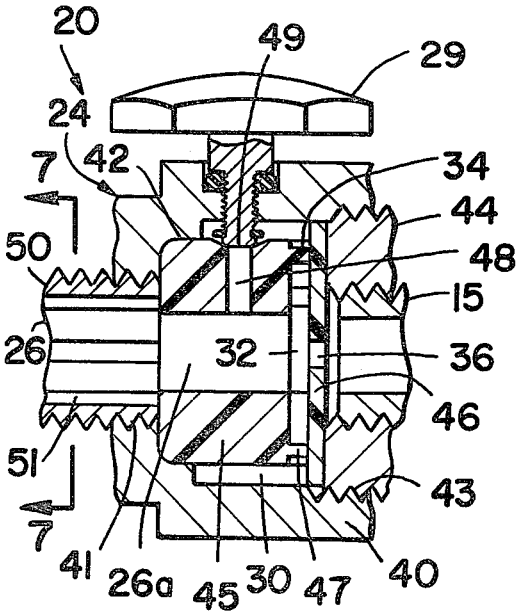
FIG. 5 is an enlarged fragmentary cross-sectional view taken along lines 5—5 of FIG. 3.

Referring to FIG. 5, an enlarged cross-sectional view of the generator portion of a vortex tube 20, according to a preferred embodiment of this invention, is shown with the improvements of this invention depicted in detail. Thus, according to the preferred embodiment of this invention, the vortex generator 24 comprises a cup-like member 40 made of aluminum, for example, having a right circular cylindrical inner surface with a generally planar bottom. A threaded aperture 41 is provided through the bottom of the cup-like member 40. In addition, the inner surface of the bottom of the cup-like member 40 is provided with a seat 42 surrounding the aperture 41. The inner surface 43 at the free end of the cup 40 is threaded to receive an appropriately threaded apertured plug 44. As best shown in FIG. 4, a threaded aperture is provided through the sidewall of the cup 40 to receive the threaded end of the quick disconnect inlet coupling 12.

According to this embodiment of the invention, a hollow cylindrical body 45 and an apertured washer 46 are received within the cup member 40 to define the re-entrant cavity 30 and circular volume 32 therewithin. Thus, one end of the hollow cylindrical body 45 is adapted to be received in the seat 42 formed in the bottom of the cup-like member 40 and the other end of the hollow cylindrical body 45 is provided with a plurality of forwardly projecting tabs or flange segments 47.

As best shown in FIG. 5, the diameter of the outer surface of the hollow cylindrical body 45 is smaller than the diameter of the inner cylindrical surface of the cup member 40. However, the diameter of the washer 46 is substantially the same as the inner diameter of the cylindrical surface of the cup member 40. Thus, the washer 46 is received within the cup member 40 and abuts the tabs or flange segments 47 on the end of the hollow cylindrical body 45. The plug member 44 is threaded into the cup member 40 and forces the washer against the flange segments 47 on the end of the hollow cylindrical body 45. In addition, the plug member 44 forces the hollow cylindrical body 45 firmly against the seat 42 in the bottom of the cup member 40.

Figure 6:
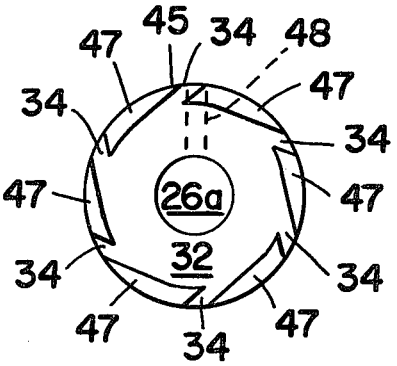
FIG. 6 is an end view in elevation of a portion of the generator structure of the vortex tube showing the nozzles which generate the vortex action within the tube.

As best shown in FIG. 6, the spacing between the flange segments 47 in the end of the hollow cylindrical body 45 provide a nozzle means 34 through which air or other suitable gas may pass into the right circular cylindrical volume 32, defined by the opposed surfaces of the washer 46 and body 45, from the remainder of the cavity 30 within the cup member 40. The flange segments 47 and nozzle means 34 therebetween, are shaped to produce a vortex or swirling of the air or other gases within the volume 32.

The central opening in the hollow cylindrical body 45 provides the initial portion **26*a* of the passageway 26 and the hole in the center of the washer 46 provides the opening 36 into the circular volume 32** required to provide the vortex tube operation.

According to this invention, a passageway 48 is provided through the sidewall of the body 45 communicating between the hollow interior **26*a* of the body 45 and the portion of the cavity 30 outside the circular volume 32. A valve means 49 is provided for selectively closing the passageway 48**.

When the passageway 48 is closed by the valve means 49, the vortex generator 24 will function in a normal fashion. However, as the valve means 49 is actuated to progressively open the passageway 48, progressively larger amounts of air or other appropriate gas introduced into the cavity 30 through the coupling 12 will be allowed to flow directly from the cavity 30 into the hollow interior **26*a* of the body 45 thereby by-passing the nozzles 34 and vortex generated within the volume 32. Thus, when the valve means 49 is fully open, there will be no vortex action created within the vortex generator 28 and the device will function as a simple "T" dividing the gas flow between its two branches. It will be seen that the flow in the two branches will remain substantially constant regardless of whether the valve means 49 is open or closed. However, maximum temperature differential between the flow in the two branches will be obtained when the valve means 49 is fully closed and there will be substantially no temperature differential between the flow in the two branches when the valve means 49** is fully open.

Thus, the passageway 48 and valve means 49 according to the teaching of this invention, provides a simple and inexpensive means for controlling the temperature of both the hot stream and the cold stream without substantial change in the volume of flow in either stream.

In the preferred embodiment of this invention as shown in FIG. 5, the valve means may comprise a simple shaft having a diameter slightly larger than the diameter of the passageway 48 and mounted through an opening in the sidewall of the cup-like member 40 by means of appropriate threads so that the end of the shaft may be selectively brought into sealing engagement with the open end of the passageway 48. The control knob 29 on the external end of the shaft provides for convenient manual adjustment of the valve means 49 provided by the shaft to obtain the desired temperature in the hot and cold streams produced by the device 20. As shown in FIG. 5, an appropriate sealing means may be provided about the shaft as necessary and desirable to prevent the escape of pressurized air through the threaded engagement of the shaft with the cup-like member 40.

Figure 7:
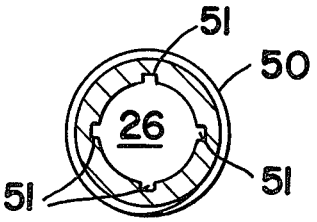
FIG. 7 is a cross-sectional view taken along line 7—7 of FIG. 5.

As best shown in FIGS. 5 and 7, the distal end portion of the passageway 26 is provided by an external threaded tube 50, mounted in the threaded opening 41 in the bottom of the cup member 40. The tube 50 has an internal diameter substantially equal to the internal diameter of the hollow interior **26*a* of the body 45** and provides a coaxial extension thereof.

According to this invention, one or more longitudinally extending grooves 51 are provided in the inner surface of the tube 50. In the preferred embodiment of this invention shown in the drawing, there are four such grooves 51 located at the quarter points of the internal surface of the tube 50. Also, according to the embodiment of this invention shown in the drawing, such grooves 51 are rectilinear and extend for the full length of the passageway 26 provided by the tube 50. A cap member 52 having an internally threaded passageway engages the external threads on the tube 50 at the distal end thereof and provides both the passageway 38 for exhaust of the hot stream as well as a mounting for the coupling member 17 and muffler 18.

Although the exact operation of the grooves 51 is not fully understood, it has been found that a short length of the tube 50 with grooves 51 therein as shown in the drawing, will provide an efficiency in operation equal to that of an ordinary smooth tube as used in the prior art, having a length that is many times greater. In the embodiment shown in the drawing, a grooved tube 50 of given diameter and only about one inch long provides the same temperature differential between the hot and cold streams as that provided by a smooth bore tube according to the prior art of the same diameter having a length of more than three inches. Stated in another way, it has been found that the vortex tube 20 according to this invention as shown in FIGS. 2 and 4, will provide at least the same temperature differential as that provided by the vortex tube 10 shown in FIG. 1, although the passageway 16 of FIG. 1 has a length which is more than fourteen times its diameter, and the length of the passageway 26 of the vortex tube 20 according to this invention is only about five times its diameter.

In normal operation, a vortex tube according to the embodiment of this invention 20 shown in FIG. 2 is capable of providing a temperature differential of at least 80° F. between the hot and cold streams thereof. For example, if air is compressed to about thirty pounds per square inch gauge, it will be heated to some extent above ambient by the compressor. Thus, assuming that the compressed air is at a temperature of about 100° F. when introduced from the compressor to the device 20 through the coupling 12, a cold stream of about 60° F. will be produced at the coupling 15 and a hot stream of about 140° F. will exit the muffler 18, assuming that the valve means 49 is fully closed. As the valve means is opened, the temperature of the cold stream will increase toward 100° F. and the temperature of the hot stream will decrease toward 100° F. When the valve means 49 is fully open, the temperature of both streams will be the same as the temperature of the incoming air, or about 100° F.

It is noted that the diameter of the passageway 38 is chosen so that the volume of the hot stream will be substantially the same as the volume of the cold stream. It is believed that the grooves 51 in the inner surface of the tube 50 "peel off" the hot gases and conduct them to the distal end of the passageway 26 to provide efficiency in operation. It has been found that such grooves must extend for about two-thirds the length of the passageway 26 in order to provide the desired effect. In a tube 50 having an internal diameter of ¼", grooves 3/32" wide and 15/1000" deep were found to provide the full desired effect where two or more of such grooves are provided. Obviously the grooves 51 define a spiral about the inner surface of the tube 50 although it is not believed that any substantial change in the desired effect is obtained thereby.

It is anticipated that those skilled in the art will make obvious modifications in the embodiment of the invention disclosed and claimed herein without departing from the scope of the following claims.

What is claimed is:

1. In a vortex tube having a generator portion defining a re-entrant cavity with right circular cylindrical sidewalls and planar end walls defining a right circular cylindrical volume within said cavity, nozzle means interposed between said volume and the remainder of said cavity and extending substantially tangential to said volume, an inlet coupling communicating with said cavity outside said volume, a first outlet passageway of given length and having a diameter smaller than the diameter of said volume communicating with said volume concentrically therewith through one end wall of said cavity, a second outlet passageway communicating with said volume concentrically therewith through an opening in the other end wall of said cavity having a diameter smaller than said diameter of said first outlet passageway, the improvement comprising a groove in the inner surface of said first outlet passageway extending longitudinally of said passageway from the distal end thereof.

2. The improvement of claim 1 wherein said plurality of grooves are provided in the inner surface of said first passageway extending longitudinally of said first passageway from the distal end thereof.

3. The improvement of claim 2 wherein said grooves are rectilinear and extend parallel to each other and to the axis of said first passageway.

4. The improvement of claim 3 wherein there are four of said grooves equally spaced about the inner surface of said first passageway.

5. The improvement of claim 4 wherein said given length of said first passageway is about five times the diameter thereof and said grooves extend about two-thirds the length of said passageway.

6. In a vortex tube having a generator portion defining a right circular cylindrical re-entrant cavity with planar end walls, the re-entrant portion of said cavity defining a right circular cylindrical volume within said cavity, nozzle means interposed between said volume and said cavity and extending tangential to said volume, an inlet tube communicating with said cavity outside said volume, a first outlet tube of given length and having a diameter smaller than the diameter of said volume communicating with said volume concentrically therewith through one end wall of said cavity, a second outlet tube communicating with said volume concentrically therewith through an opening in the other end wall of said cavity having a diameter smaller than said diameter of said first outlet tube, the improvement comprising a passageway communicating between said cavity outside said volume and one of said first outlet tube and said second outlet tube at a point adjacent said volume and valve means for selectively closing said passageway.

7. The improvement of claim 6 wherein said passageway has a diameter at least about equal to said opening in said other wall of said cavity and communicates between said cavity and said first outlet tube.

8. The improvement of claim 7 wherein said valve means comprises a threaded member sealingly extending through a threaded opening in the side wall of said cavity and into selective engagement with the opening of said passageway which communicates with said cavity, said threaded member being rotatable by means outside said cavity.

9. The improvement of claim 1 including a passageway communicating between said cavity outside said volume and one of said first outlet tube and said second outlet tube and valve means for selectively closing said passageway.

10. A vortex tube comprising a cup-like member having an internal surface with right circular cylindrical sidewalls and a generally planar bottom, a circular seating surface of reduced diameter formed in the bottom of said internal surface of said cup-like member concentrically therewith, an opening of given diameter smaller than said reduced diameter of said seating surface formed concentrically therewith through the bottom wall of said cup-like member, a hollow right circular cylindrical body having an external diameter equal to said reduced diameter of said seating surface and an internal diameter substantially equal to said given diameter of said opening mounted within said cup-like member coaxially of said right circular cylindrical sidewalls thereof, one end of said body being in seating engagement with said seating surface and the other end of said body being provided with an axially projecting flange having a diameter larger than said given diameter of said opening in said bottom of said cup with chordally extending notches therethrough, a washer member having an external diameter equal to the internal diameter of said right circular cylindrical sidewalls of said internal surface of said cup-like member in seating engagement with said axially projecting flange on said body, said washer having a central opening therethrough of smaller diameter than said given diameter of said opening through said bottom of said cup-like member, a passageway through the sidewall of said body having a diameter at least equal to the diameter of said central opening through said washer, a valve means selectively closing the end of said passageway through said sidewall of said body, and a tube mounted in coaxial communication with said opening through said bottom wall of said cup-like member, said tube having an internal surface with a diameter substantially equal to said internal diameter of said body and with a longitudinally extending groove formed therein.

* * * * *

UNITED STATES PATENT AND TRADEMARK OFFICE

CERTIFICATE OF CORRECTION

PATENT NO. : 4,339,926

DATED : July 20, 1982

INVENTOR(S) : ANTHONY L. MORETTI; LESTER W. FERRIS

It is certified that error appears in the above—identified patent and that said Letters Patent is hereby corrected as shown below:

Column 1, line 40 - change "stream" to --streams--

Column 1, line 50 - after "stream" insert --will--

Column 2, line 49 - change "communicated" to --communicates--

Column 8, line 15 - delete "said" and substitute --a--

Signed and Sealed this

*Twenth-eighth* Day of *September 1982*

[SEAL]

*Attest:*

GERALD J. MOSSINGHOFF

*Attesting Officer*

*Commissioner of Patents and Trademarks*